US005289945A

United States Patent [19]

Stradder

[11] Patent Number: 5,289,945

[45] Date of Patent: Mar. 1, 1994

[54] SEALING AND DISPENSING CAP

[76] Inventor: Robert H. Stradder, 165 W. End Ave., Apt. 10 A, New York, N.Y. 10023

[21] Appl. No.: 846,255

[22] Filed: Feb. 27, 1992

[51] Int. Cl.[5] ..... B67D 5/06

[52] U.S. Cl. ..... 222/23; 222/561; 220/253

[58] Field of Search ..... 222/548, 555, 559, 561, 222/23; 220/90.4, 254, 253

[56] References Cited

U.S. PATENT DOCUMENTS

| | | | |
|---|---|---|---|
| 1,685,147 | 9/1928 | Case | 220/253 X |
| 2,366,644 | 1/1945 | Nyden | 222/555 |
| 2,555,459 | 6/1951 | Seufer | 222/561 |
| 2,666,555 | 1/1954 | Hill | 222/561 X |
| 3,118,577 | 1/1964 | Estabrook | 222/561 X |
| 3,363,978 | 1/1968 | Garangiotis | 222/561 X |
| 3,696,977 | 10/1972 | Davenport et al. | 222/561 |
| 3,731,855 | 5/1973 | Vos | 222/555 X |
| 4,015,602 | 4/1977 | Nelson et al. | 222/561 X |
| 4,057,167 | 11/1977 | Lee | 220/90.4 |
| 5,058,778 | 10/1991 | Weinstein | 222/555 X |

*Primary Examiner*—Gregory L. Huson
*Attorney, Agent, or Firm*—Abdallah & Muckelroy

[57] ABSTRACT

A sealing and dispensing cap for a carbonated drink container permits the container to be inverted with the cap disposed in a closed position to trap carbonating gases, whereupon the cap is disposed in an open position to dispense the carbonated drink. This cap prevents carbonated drink from going "flat" by preventing the escape of carbonating gases during drink dispensation.

4 Claims, 3 Drawing Sheets

SEALING AND DISPENSING CAP

BACKGROUND OF THE INVENTION

The present invention generally relates to container sealing and dispensing means. More specifically, this invention relates to airtight caps for carbonated drink containers which permit selective dispensing of carbonated drink without removing the cap.

Carbonated drinks left open for an extended period of time tend to go "flat," i.e. the drinks lose their flavor and the "fizz" known for carbonated drinks. As the conventional carbonated drink container cap is removed and re-attached air enters the container and carbonating gases escape. By the time the container is nearly empty, the last portion of the drink is flat and tasteless. Thus, a preferred cap for a carbonated drink container provides airtight sealing means which can be selectively opened and closed without allowing air to enter or carbonating gases to escape the container.

SUMMARY OF THE INVENTION

The present invention discloses two embodiments of a sealing and dispensing cap for a carbonated drink container having dispensing means which maintain an airtight seal during use. A first embodiment of the sealing and dispensing cap of the present invention generally comprises a cap body having a laterally-extending cap sealing plate which divides the cap body into an upper portion and a lower portion. A central aperture is formed in the cap sealing plate. The lower portion of cap body is formed as an annular member having an open lower end and a threaded inner side wall. The open lower end of cap body selectively engages the threaded neck of a carbonated drink container. The upper portion of the cap body has an extending nipple integrally formed at an upper end thereof. A channel extends through the upper portion of cap body from the aperture of the cap sealing plate to an outside portion of the nipple. A lever arm is slidably received laterally through the upper portion of the cap body adjacent to the upper wall of cap sealing plate. Lever arm includes a substantially centrally-disposed lever arm opening. Lever arm selectively opens and closes communication between the channel in the upper portion of cap body and the aperture of cap sealing plate by selective alignment and misalignment of lever arm opening with the channel. Respective ends of the lever arm extend beyond opposing sides of the cap body for sliding operation of lever arm between open and closed positions.

A second embodiment of a sealing and dispensing cap constructed in accordance with the teachings of the present invention is useful for a carbonated drink container having a non-threaded neck. The second sealing and dispensing cap generally comprises a first cap portion fixedly attachable to the neck of a carbonated drink container, and a second cap portion rotatably attached to the upper end of the first cap portion. First cap portion includes a cap sealing plate having an aperture formed therein. Second cap portion includes a nipple integrally formed at an upper end thereof and a channel extending through the nipple to the cap sealing plate aperture. The channel of second cap portion selectively aligns with the cap sealing plate aperture by rotation of second cap portion for selective dispensing of carbonated drink.

The sealing and dispensing caps of the present invention provide sealing means that permit a carbonated drink container to be inverted prior to opening the cap, thereby trapping carbonating gases. With the drink container inverted the cap can then be opened for selective dispensing of fully carbonated drink.

An object of the present invention is to provide a sealing and dispensing cap for carbonated drink containers that prevents carbonated drink from going flat between dispensations.

Another object of this invention is to provide a cap for a carbonated drink container that can be selectively opened and closed without removing the cap from the container.

A further object of this invention is to provide carbonated drink container dispensing means that permits trapping of carbonating gas for even dispersion of the gas throughout the carbonated drink.

A still further object of the present invention is to provide a cap for a carbonated drink container that permits one-hand selective dispensing of a fully carbonated drink.

These and other objects and advantages of the sealing and dispensing cap of the present invention will be apparent to those skilled in the art from the following description of preferred embodiments, claims and appended drawings.

DESCRIPTION OF PREFERRED EMBODIMENTS

Figure 1:
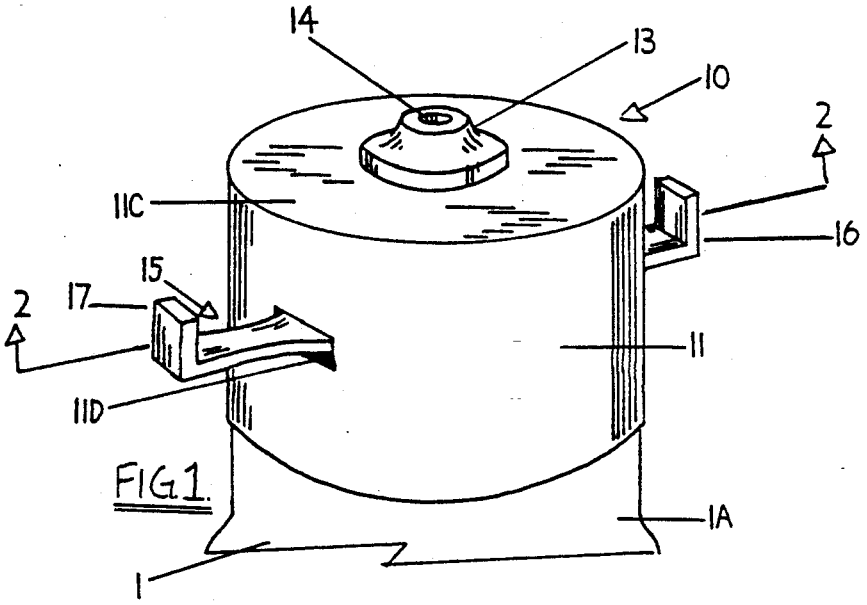
FIG. 1 is a top perspective view of a first preferred embodiment of a sealing and dispensing cap in accordance with the teachings of the present invention shown attached to a fragmented portion of a drink container.

FIG. 1 illustrates in a top perspective view a first preferred embodiment of the sealing and dispensing cap 10 of the present invention. First cap 10 is suitable for use with a carbonated drink container 1 having a threaded neck la. First cap 10 generally comprises a cap body 11 having a dispensing channel 14 formed therein and a lever arm 15 slidably extending laterally therethrough. Lever arm 15 provides means to selectively open and close the dispensing channel 14 as hereinafter described in greater detail.

Figure 2:
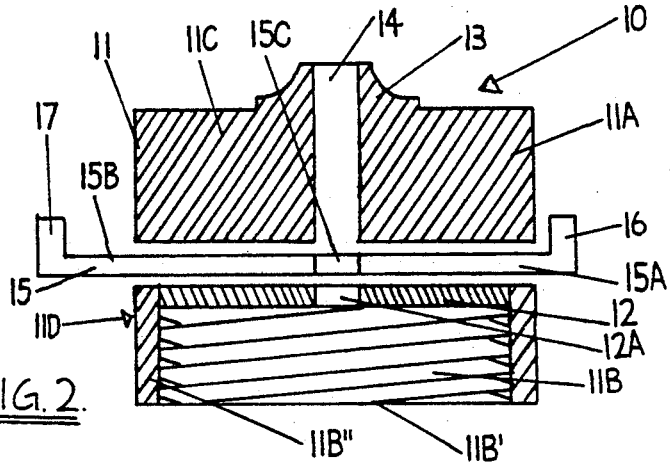
FIG. 2 is a vertical cross-sectional view taken along line 2—2 of FIG. 1 illustrating the open position of the first cap.
Figure 3:
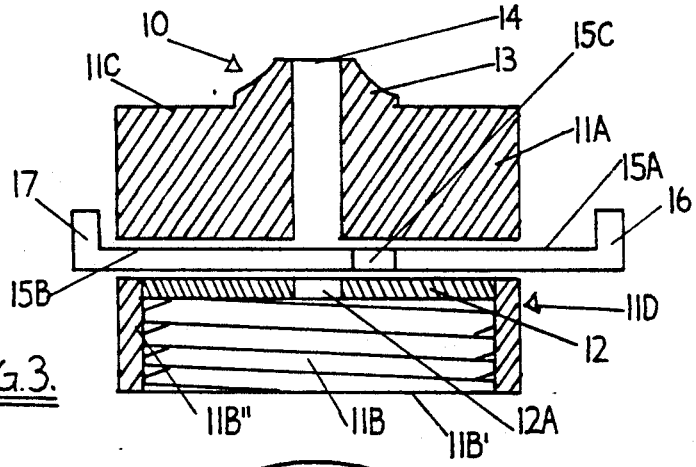
FIG. 3 is a vertical cross-sectional view of the first cap illustrating its closed position.

Referring now to FIGS. 2 and 3, it can be seen that the cap body 11 of first cap 10 includes a cap sealing plate 12 which extends laterally across a mid-portion of cap body 11 dividing cap body 11 into an upper cap body portion 11*a* and a lower cap body portion 11*b*. Cap sealing plate 12 includes a central aperture 12*a*.

Upper cap body portion 11a includes a nipple 13 integrally formed with a top wall 11c of upper cap body portion 11a and a channel 14. Channel 14 extends from an outside portion of nipple 13 through upper cap body portion 11a. A lower end of channel 14 is vertically aligned with the central aperture 12a of a cap sealing plate 12. In the first cap 10, nipple 13 is centrally disposed on a top wall 11c of cap body 11.

Lower cap body portion 11b is formed having an open lower end 11b' and a threaded inner side wall 11b''. The inner side wall 11b'' of lower cap body portion 11b threadedly engages the neck 1a of a carbonated drink container 1, for example a 2-liter cola bottle.

Figure 4:
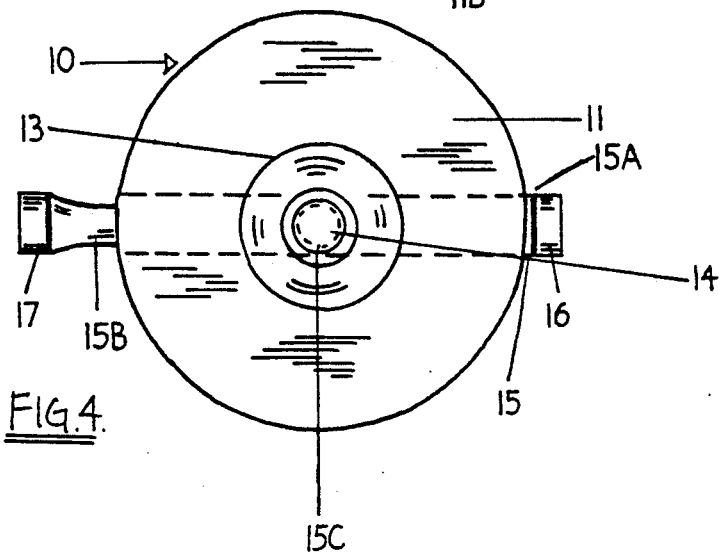
FIG. 4 is a top plan view of the first cap.

Lever arm 15 slidably extends laterally through a slot 11d formed in the upper cap body portion 11a of cap body 11 adjacent to the top wall of cap sealing plate 12. Lever arm 15 is substantially a flat extended member having a first push/pull tab 16 orthogonally and integrally formed at a first end 15a of lever arm 15, a second push/pull tab 17 orthogonally and integrally formed at a second end 15b of lever arm 15, and a transverse lever arm opening 15c formed in lever arm 15 between said first end 15a and said second end 15b. The slot 11d receiving lever arm 15 is preferably formed as a rectangular cross-sectioned opening of consistent dimensions from opposing sides of cap body 11. First push/pull tab 16 and second push/pull tab 17 are distinctively marked, for example by respective coloring, to facilitate recognition of the respective open and closed positions of first cap 10. Preferably, first push/pull tab 16 is colored green and second push/pull tab 17 is colored red. As can be seen in the top plan view of first cap 10 illustrated in FIG. 4, the first end 15a of lever arm 15 is formed having flat side walls and the second end 15b of lever arm 15 is formed having convexly-curved side walls. The curved side walls of the second end 15b of lever arm 15 facilitate airtight sealing engagement of second end 15b in slot 11d when lever arm 15 is disposed in the closed position.

When lever arm 15 is disposed in the open position (FIG. 2) the lever arm opening 15c of lever arm 15 is vertically aligned between the channel 14 of upper cap body portion 11a and the central aperture 12a of cap sealing plate 12. When lever arm 15 is disposed in the closed position (FIG. 3) lever arm opening 15c is misaligned with channel 14 and cap sealing plate aperture 12a.

To utilize the first cap 10 of the present invention for dispensation of a carbonated drink, first cap 10 is attached to the carbonated drink container 1 by engaging the threaded inner side wall 11b'' of cap body 11 to the neck 1a of container 1 with lever arm 15 disposed in the closed position. The container is then inverted to trap carbonating gases in the container 1 above the carbonated drink. Lever arm 15 is then slid laterally to its open position whereupon the carbonated drink is dispensed. When the desired amount of drink is released, lever arm 15 is returned to the closed position and container 1 is returned to its upright position. Thereby, no air is permitted to enter the container and no carbonating gas escapes from the container 1.

Figure 5:
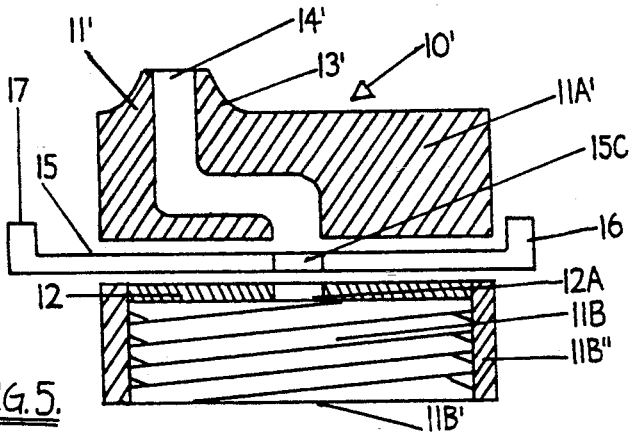
FIG. 5 is a vertical cross-sectional view of an alternative construction of the first cap.

FIG. 5 illustrates in a vertical cross-sectional view an alternative construction of the first sealing and dispensing cap 10' of the present invention. Alternative first cap 10' is formed substantially identical to first cap 10 with the exception that alternative upper cap body portion 11a' includes an offset nipple 13' disposed to one side of the top wall 11c of alternative cap body 11'. An alternative channel 14' is therefore curved to extend from offset nipple 13' to a lower end of alternative channel 14' disposed vertically aligned with the cap sealing plate aperture 12a.

Referring now to FIGS. 6–9, a second preferred embodiment of a sealing and dispensing cap 20 constructed in accordance with the teachings of the present invention is shown. Second cap 20 is suitable for use with a second carbonated drink container 2 having a non-threaded neck 2a.

Figure 6:
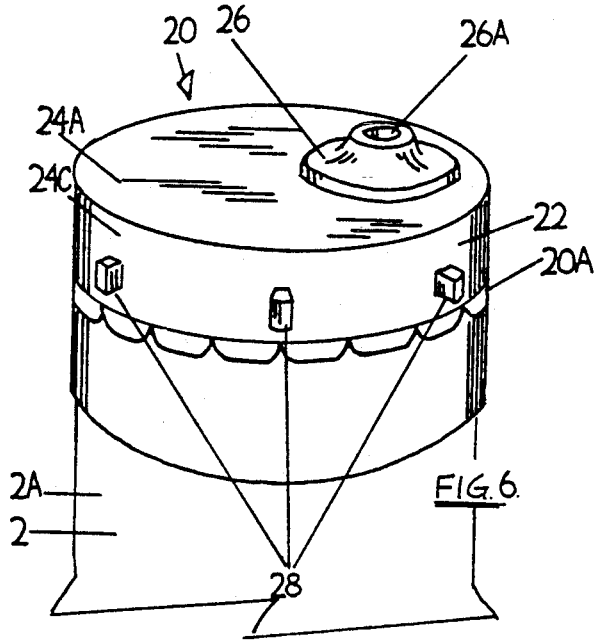
FIG. 6 is a top perspective view of a second preferred embodiment of a sealing and dispensing cap constructed in accordance with the teachings of the present invention.

FIG. 6 illustrates a top perspective view of second cap 20. Second cap 20 generally comprises a recessed first cap portion 21 fixedly attachable to the non-threaded neck 2a of second carbonated drink container 2, and a second cap portion 22 rotatably attached to first cap portion 21. First cap portion 21 and second cap portion 22 are preferably fixedly attached in a closed position by temporary fastening means 20a, for example, a perforated seal 20a.

Figure 8:
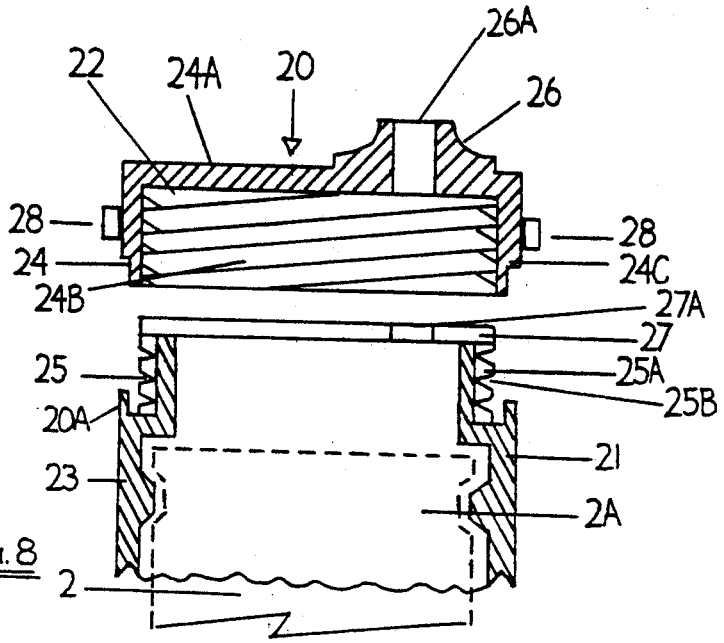
FIG. 8 is an exploded vertical cross-sectional view of the second cap.
Figure 7:
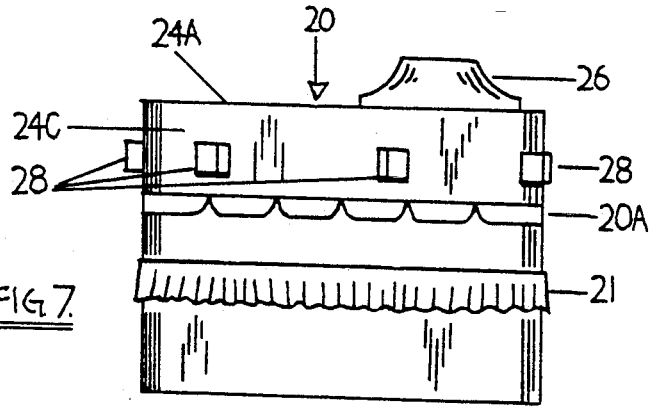
FIG. 7 is a side elevational view of the second cap.

First cap portion 21 includes a container attachment portion 23, preferably comprising clamping sealing means 23 and an attachment portion neck 25 (FIG. 8). Container attachment portion 23 sealingly and fixedly engages the non-threaded neck 2a of second carbonated drink container 2. Attachment portion neck 25 is integrally formed with an upper portion of container attachment portion 23. As can be seen in FIG. 8 the outer wall 25a of attachment portion neck 25 is threaded for receipt of second cap portion 22. A detent stop 25b is formed on the outer wall 25a between respective threads thereof for selective positioning of second cap portion 22 as hereinafter described in greater detail. A second cap sealing plate 27 is fixedly attached to a top portion of attachment portion neck 25. Second cap sealing plate 27 includes an eccentrically-disposed aperture 27a which communicates through the container attachment portion 23 with second container 2.

Second cap portion 22 includes a second cap portion main body 24 and a second nipple 26 integrally formed on a top wall 24a of main body 24. The inner wall 24b of second cap portion main body 24 is complementarily threaded for rotatable engagement of second cap portion 22 with the attachment portion neck 25 of the container attachment portion 23 of first cap portion 21. A detent 24c is formed on the threaded inner wall 24b of second cap portion main body 24 which engages the detent stop 25b of first cap portion 21 when the second cap 20 is disposed in its open position as hereinafter described. A vertical slot (not shown) may be formed in container attachment portion neck 25 for initial receipt of detent 24c or second cap portion 22 may be formed from flexible material permitting detent 24c to expand over the outer wall 25a of container attachment portion neck 25. Second nipple 26 includes a nipple channel 26a extending therethrough. Second nipple 26 is eccentrically disposed on the top wall 24a at a radius permitting vertically alignment of nipple channel 26a with sealing plate aperture 27a in the open position of second cap 20. Second cap portion 22 further includes at least one, but preferably a plurality of raised protrusions 28 extending laterally from the side wall 24c of second cap portion main body 24. Said raised protrusions 28 provide means to facilitate rotation of second cap portion 22 relative to first cap portion 21 utilizing the thumb or a single finger while holding the second container 2 in an inverted position.

Figure 9:
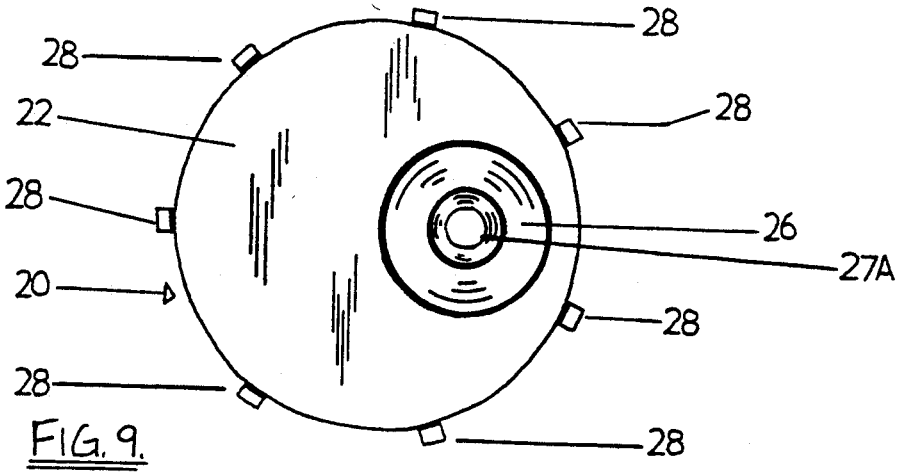
FIG. 9 is a top plan view of the second cap.

For operation of second cap 20 for sealing of and selective dispensing from a second carbonated drink container 2, second cap 20 is fixedly attached to the non-threaded neck 2 of the container by engaging the container attachment portion 23 thereto. Initially, the second cap portion 22 of second cap 20 is fixedly attached to the first cap portion 21 by means of the perforated seal 20*a* with second cap 20 disposed in its closed position, i.e., with the nipple channel 26*a* and the sealing plate aperture 27*a* disposed in vertical misalignment (FIG. 9). Carbonated drink container 2 is inverted to trap the carbonating gases. Second cap portion 22 is then rotated on first cap portion 21 by engaging the raised protrusions 28 with the thumb until the detent 24*c* of second cap portion 22 is brought into bearing engagement with the detent stop 25*b* of first cap portion 21. Thereupon the nipple channel 26*a* is vertically aligned with the sealing plate aperture 27*a*, i.e. second cap 20 disposed in its open position, and carbonated drink is thereafter dispensed. Second cap portion 22 is then rotated in the opposite direction with second container 2 inverted to return second cap 20 to its closed position. Container 2 is then returned to its upright position.

Various changes, additions and modifications may be made to the preferred embodiments of the present invention without departing from the spirit and scope of this invention. Such changes, additions and modifications within a fair reading of the following claims are intended as part of the present invention. Furthermore, while this invention has been described for use on a carbonated drink container, it should be understood that its utility extends to other types of containers and packagings.

Therefore, in view of the foregoing I claim:

1. A sealing and dispensing cap for a container comprising a cap body having a cap sealing plate extending laterally across substantially a mid-portion of said cap body thereby dividing said cap body into an upper cap body portion and a lower cap body portion, said upper cap body portion including dispensing means and said lower cap body portion including container attachment means, said cap sealing plate having a sealing plate aperture formed therein communicating with an inside portion of said container, said upper cap body portion being formed having a top wall that includes a nipple integrally formed with the top wall of said upper cap body portion, said dispensing means including a lever arm extending laterally through a slot formed in said upper cap body portion between the lower end of said dispensing means and said cap sealing plate, said lever arm projecting to opposing sides of said upper cap body portion, said lever arm having a lever arm opening formed therein, said lever arm being slidably moveable laterally for selective vertical alignment and misalignment of said lever arm opening and said sealing plate aperture, said lever arm comprising a substantially flat extended member having a first push/pull tab orthogonally and integrally formed at a first end of said lever arm and a second push/pull tab orthogonally and integrally formed at a second end of said lever arm, said lever arm opening being disposed between the respective first and second ends of said lever arm, the respective first and second push/pull tabs being marked distinctively, one to the other.

2. A sealing and dispensing cap as in claim 1 wherein said first push/pull tab is colored green and said second push/pull tab is colored red.

3. A sealing and dispensing cap as in claim 1 wherein the flat extended member of the lever arm adjacent to the first end of said lever arm is formed having flat side walls, and the flat extended member of the lever arm adjacent to the second end of said lever arm is formed having convexly-curved side walls of sufficient curvature to selectively engage said slot formed in the upper cap body portion in sealing engagement.

4. A sealing and dispensing cap for a container comprising a cap body having a cap sealing plate extending laterally across substantially a mid-portion of said cap body thereby dividing said cap body into an upper cap body portion and a lower cap body portion, said cap sealing plate having a sealing plate aperture formed therein communicating with an inside portion of said container, said upper cap body portion having a nipple integrally formed with the top wall thereof and a dispensing channel extending through said nipple and said upper cap body portion, a lower end of said dispensing channel being disposed in vertical alignment with said sealing plate aperture, said lower cap body portion being threadedly attachable to a neck portion of said container; and a lever arm extending laterally through a slot formed in said upper cap body portion between the lower end of said dispensing means and said cap sealing plate, said lever arm projecting to opposing sides of said upper cap body portion, said lever arm having a lever arm opening formed therein and being slidably moveable laterally for selective vertical alignment and misalignment of said lever arm opening and said sealing plate aperture, said lever arm comprising a substantially flat extended member having a first push/pull tab disposed at a first end of said flat extended member and a second push/pull tab disposed at a second end of said flat extended member, said respective first and second push/pull tabs being distinctively marked by respective first an second marking means, said flat extended member adjacent to the first end thereof having flat side walls and said flat extended member adjacent to the second end thereof having convexly-curved side walls of sufficient curvature to selectively engage the slot formed in said upper cap body portion in sealing engagement.

* * * * *